US011193443B2

(12) United States Patent
Whittaker et al.

(10) Patent No.: US 11,193,443 B2
(45) Date of Patent: Dec. 7, 2021

(54) METHOD OF ESTIMATING SOOT USING A RADIO FREQUENCY SENSOR

(71) Applicant: Perkins Engines Company Limited, Peterborough (GB)

(72) Inventors: Jonathan Whittaker, Peterborough (GB); Daniel Fitch, Peterborough (GB); Antony James Eager, Peterborough (GB); Craig Bradley, Peterborough (GB); Prashant Kumar Mishra, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 17/100,314

(22) Filed: Nov. 20, 2020

(65) Prior Publication Data

US 2021/0156327 A1 May 27, 2021

(30) Foreign Application Priority Data

Nov. 22, 2019 (GB) ..... 1917061

(51) Int. Cl.
*F02D 41/24* (2006.01)
*F02D 41/14* (2006.01)

(52) U.S. Cl.
CPC ..... *F02D 41/2432* (2013.01); *F02D 41/1467* (2013.01); *F02D 41/2474* (2013.01); (Continued)

(58) Field of Classification Search
CPC ... F01N 3/00; F01N 9/00; F01N 11/00; F02D 41/14; F02D 41/1467; F02D 41/24; (Continued)

(56) References Cited

U.S. PATENT DOCUMENTS 8,131,495 B2 3/2012 Krafthefer et al.
8,283,930 B2 10/2012 Davenport et al.
(Continued)

OTHER PUBLICATIONS

Great Britain Search Report related to Application No. 1917061.2; dated Apr. 20, 2020.

*Primary Examiner* — John Kwon
*Assistant Examiner* — Johnny H Hoang

(57) ABSTRACT

A method of calibrating a soot load estimating function for a diesel particulate filter uses radio frequency attenuation measurement and temperature measurements. The method comprises identifying a minimum mean attenuation value associated with a standard deviation that exceeds a standard deviation threshold and using this minimum mean attenuation value as a reference value. The method further comprises using a data library that contains gradient values for each of a range of possible temperature values to obtain a first gradient value, the first gradient value corresponding to the first temperature value, wherein each gradient value relates to the gradient of a linear approximation between mean attenuation and soot load at the corresponding temperature. The method involves using the reference value and the first gradient value to determine an axis intercept value for use as an offset value and adopting the offset value as a temperature-independent calibration value for the diesel particulate filter.

14 Claims, 9 Drawing Sheets

(52) U.S. Cl.
CPC ..... *F02D 2200/0802* (2013.01); *F02D 2200/0812* (2013.01)

(58) Field of Classification Search
CPC ..... F02D 41/2432; F02D 41/2474; F02D 2200/0802; F02D 2200/0812
See application file for complete search history.

(56) References Cited

U.S. PATENT DOCUMENTS

| | | | | |
|---|---|---|---|---|
| 8,384,397 | B2 | 2/2013 | Bromberg et al. | |
| 9,400,297 | B2 | 7/2016 | Bromberg et al. | |
| 10,358,965 | B2 * | 7/2019 | Lauritano | F01N 3/2066 |
| 2007/0101705 | A1 * | 5/2007 | Knitt | F01N 9/002 60/295 |
| 2008/0018442 | A1 * | 1/2008 | Knitt | F01N 3/025 340/438 |
| 2012/0159930 | A1 | 6/2012 | Snopko et al. | |
| 2015/0358091 | A1 * | 12/2015 | Sappok | F01N 11/00 455/67.11 |
| 2016/0131069 | A1 * | 5/2016 | Wackerle | F02D 41/2422 701/115 |
| 2019/0353066 | A1 * | 11/2019 | Paukner | F01N 11/005 |

* cited by examiner

METHOD OF ESTIMATING SOOT USING A RADIO FREQUENCY SENSOR

CROSS-REFERENCE TO RELATED APPLICATION

This application claims priority under 35 USC § 119 and the Paris Convention to Great Britian Patent Application 1917061.2 filed on Nov. 22, 2019.

FIELD OF THE DISCLOSURE

The disclosure relates to the field of measuring soot, for example in a diesel particulate filter, using radio frequency (RF) sensing.

BACKGROUND

It is known to use a radio frequency sensor to infer soot loading in a diesel particulate filter. Such arrangements make use of a radio frequency sensor that comprises a radio frequency transmitter and a radio frequency receiver. Radio frequency waves are transmitted across a frequency sweep by the transmitter into the diesel particulate filter. The receiver receives the radio frequency waves once influenced by passage through the diesel particulate filter. Soot in the diesel particulate filter influences the radio frequency waves during their passage through the diesel particulate filter. The radio frequency waves received by the receiver are then interpreted to determine an extent of soot loading within the diesel particulate filter.

Generally, a processor—potentially a constituent of an engine management system—receives radio frequency data from the sensor and interprets that data in order to infer soot loading within the diesel particulate filter.

The sensor may determine an attenuation value for each of a plurality of radio frequencies between a minimum radio frequency value and a maximum frequency value. The sensor may also provide an average attenuation value of the attenuation values for the plurality of radio frequencies. The sensor may further provide standard deviation data in relation to the average attenuation value.

The processor that receives data from the sensor may use the average attenuation value and the standard deviation data received from the sensor as part of a calculation by which the soot loading may be inferred. In this way, the amount of data provided by the sensor is significantly less than the complete data set of all attenuation values, one for each of the plurality of radio frequencies between a minimum radio frequency value and a maximum frequency value. This may save considerable bandwidth in the transfer of data between the sensor and the processor as well as considerable processing capacity in the processor.

The inference of soot loading from radio frequency attenuation data may require other variables to be sensed. For example, temperature of the diesel particulate filter may also influence radio frequency attenuation. As such, inferring soot loading may also require temperature data to be collected. It is known from empirical analysis that an amount of soot within a diesel particulate filter may be inferred from the mean attenuation value and the temperature of the diesel particulate filter.

A complexity arises because the nature of the system is such that, for certain radio frequencies, there may be resonant affects that result in significant attenuation. This significant attenuation at certain frequencies may influence the average attenuation value to an extent that means the capacity for inferring the soot loading in the diesel particulate filter may be compromised.

The disclosure provides techniques for addressing this complexity.

It is also known empirically that determining a change in soot load may be more straightforward and more accurate than determining an absolute amount of soot load. As such, it is known to use derivative models to infer from mean attenuation and temperature a change in soot load relative to a previous soot load.

One complexity surrounding the implementation of a derivative model is determining an accurate initial inference for soot load. This may be particularly complicated at start of life of the diesel particulate filter because it has been shown that mean attenuation values vary most widely where soot load is low.

Furthermore, since, in a derivative model, the next value is based on a change relative to the previous value, incorrect inferences perpetuate and have a potentially significant impact without inherent means for detection and correction.

The disclosure provides techniques for addressing this complexity.

SUMMARY OF THE DISCLOSURE

Against this background there is provided a method of calibrating a soot load estimating function for a diesel particulate filter, the method comprising:

- receiving a first temperature value for the diesel particulate filter;
- transmitting a plurality of radio frequencies into a first end of the diesel particulate filter;
- sensing the plurality of radio frequencies received at a second end of the diesel particulate filter;
- obtaining mean radio frequency attenuation data and standard deviation attenuation data in relation to the transmitted and sensed radio frequencies;
- identifying a mean attenuation value associated with a standard deviation that exceeds a standard deviation threshold and using this minimum mean attenuation value as a reference value;
- using a data library that contains gradient values for each of a range of possible temperature values to obtain a first gradient value, the first gradient value corresponding to the first temperature value, wherein each gradient value relates to the gradient of a linear approximation between mean attenuation and soot load at the corresponding temperature;
- using the reference value and the first gradient value to determine an axis intercept value for use as an offset value;
- adopting the offset value as a temperature-independent calibration value for the diesel particulate filter.

In this way, it is possible to calibrate a soot loading calculation function by receiving data in relation to temperature, mean attenuation and standard deviation attenuation.

DETAILED DESCRIPTION

Figure 1:
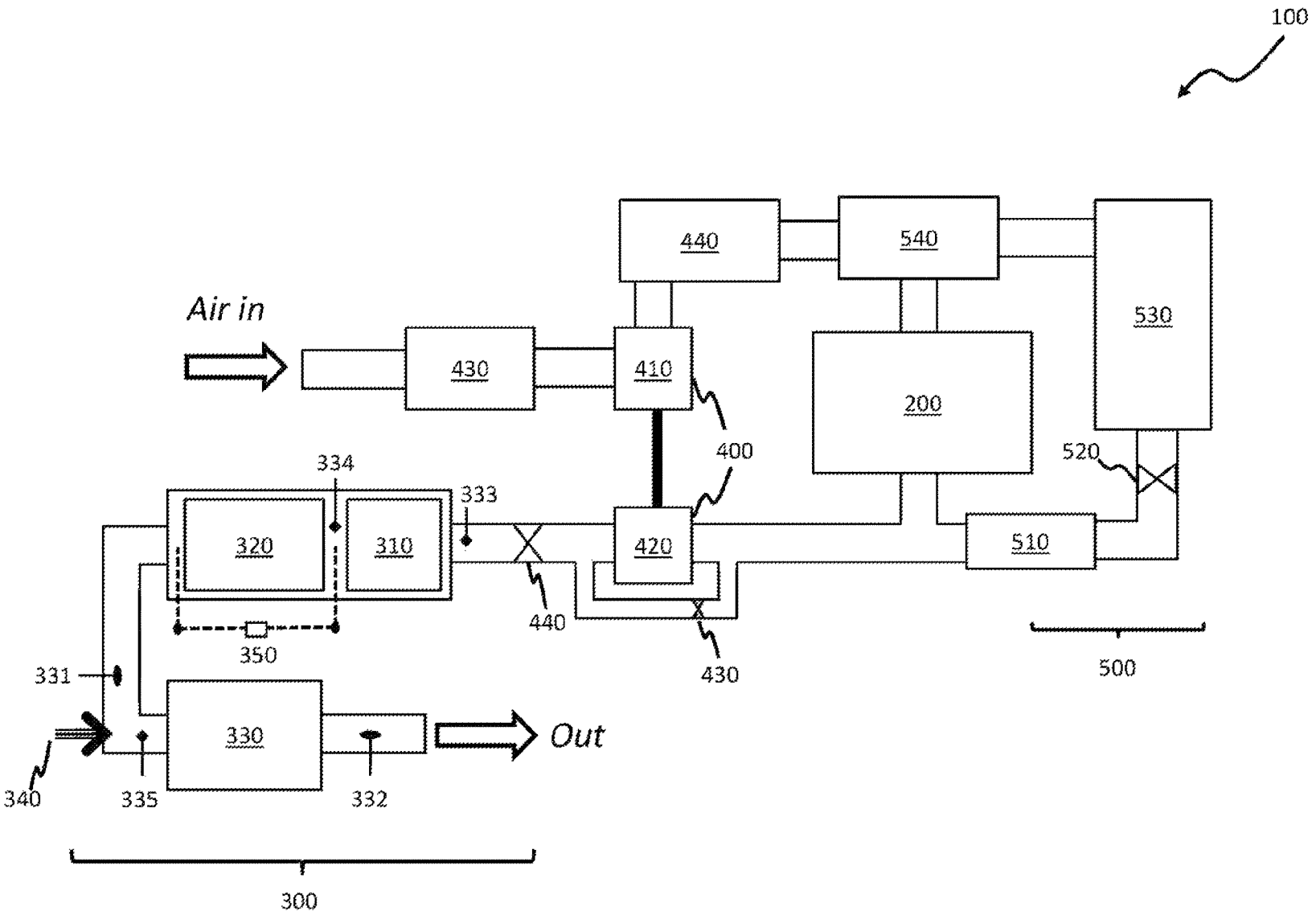
FIG. 1 shows an engine assembly comprising an internal combustion engine and an aftertreatment apparatus for use with the method of the present disclosure.

A hardware arrangement of an engine assembly 100 comprising an internal combustion engine 200 and an aftertreatment apparatus 300 comprising a radio frequency soot sensor 350 for use in accordance with the method of the disclosure is shown in FIG. 1.

In addition to the internal combustion engine and the aftertreatment apparatus, the engine assembly 100 may further comprise a turbocharger 400, and an exhaust gas recirculation circuit 500.

The exhaust gas recirculation circuit comprises an EGR pre-cooler 510, and EGR valve 520, an EGR cooler 530 and an EGR mixer 540.

The internal combustion engine 200 may comprise a combustion chamber in which fuel may combust with air in order to generate kinetic energy. Air may be provided to the combustion chamber via an air cleaner (filter) 430, a compressor 410 of the turbocharger 400, an air cooler 440 and the exhaust gas recirculation mixer 540 of the exhaust gas recirculation circuit 500.

Exhaust gas resulting from combustion in the combustion chamber may, at least in part, be recirculated via the exhaust gas recirculation circuit 500 to the exhaust gas recirculation mixer 510 such that it may be passed back through the combustion chamber in combination with air from compressor 410 of the turbocharger 400. The exhaust gas recirculation valve 520 may control flow through the exhaust gas recirculation circuit 500.

A second portion of the exhaust gas resulting from combustion in the combustion chamber may pass through the turbine of the turbocharger 420. An electronic wastegate 430 may control a bypass route by which flow may selectively bypass the turbocharger turbine 420. An exhaust backpressure valve 440 may be located downstream of the turbine 420.

The aftertreatment apparatus 300 may comprise a diesel oxidation catalyst module 310 comprising a diesel oxidation catalyst, a diesel particulate filter module 320 comprising a diesel particulate filter and a selective catalytic reduction module 330 comprising a selective reduction catalyst. An injector 340 may be located upstream of the selective reduction catalyst module 330 to provide a reductant to facilitate appropriate reactions with oxides of nitrogen ($NO_x$). $NO_x$ sensors 331, 332 may be provided both upstream of and downstream of the selective catalytic reduction module.

Of particular relevance to the method of the present disclosure is the radio frequency soot sensor 350 that is associated with the diesel particulate filter module 320. The radio frequency soot sensor 350 may comprise an antenna and a receiver. The antenna and the receiver may be located with a gap therebetween. The gap may be between an upstream end and a downstream end of the diesel particulate filter 320 or may be between opposite sides of a diesel particulate filter 320. The relative location of the antenna and receiver may influence the data provided by the radio frequency soot sensor 350, including in the absence of soot within the diesel particulate filter 320. Data provided by the radio frequency soot sensor 350 may also be influenced by the geometry of the diesel particulate filter 320.

In some embodiments, further sensors may be provided. For example, there may be provided: a diesel oxidation catalyst module inlet temperature sensor 333; a diesel particulate filter inlet temperature sensor 334; and a selective catalytic reduction module inlet temperature sensor 335. Other sensors may also be provided.

In one arrangement, the radio frequency soot sensor may transmitting a plurality of radio frequencies into a first end of the diesel particulate filter and sense the plurality of radio frequencies received at a second end of the diesel particulate filter. The plurality of radio frequencies comprises between 100 and 300 discrete frequencies, such as for example 200 discrete frequencies or approximately 200 discrete frequencies.

The transmission may comprise a radio frequency sweep which may be performed at set time interval. The data received at each time interval may include mean attenuation value and standard deviation attenuation value.

Standard deviation may be particularly high for low soot loads. This is believed to be a consequence of radio frequency resonance.

In accordance with the present disclosure there is provided a model for using the mean and standard deviation attenuation data to infer soot load. Inferring soot load means calculating an estimate of soot load.

Figure 2:
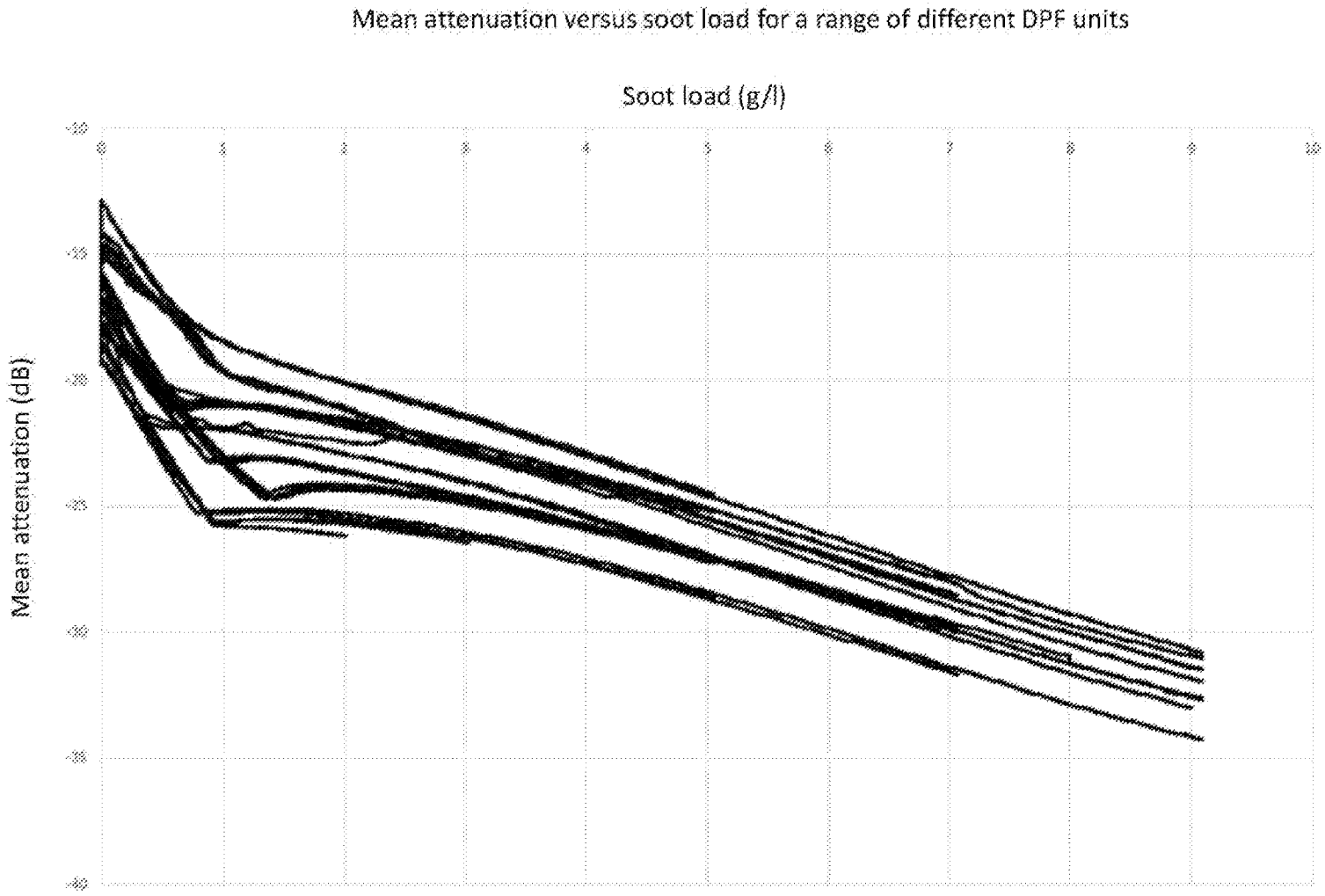
FIG. 2 shows, for a range of diesel particulate filters at a fixed temperature, a plot of measured mean attenuation versus known soot load.

Determination of the model for inferring soot load in accordance with the present disclosure first involves obtaining empirical data regarding the relationship between soot load and mean attenuation for a variety of diesel particulate filters, having different sizes and geometries. FIG. 2 shows a plot, for a particular temperature (225° C.), of mean attenuation (dB) against soot load (in grams per litre of diesel particulate volume) for a range of different diesel particulate filters. Variation is seen not only in diesel particulate filters of different sizes and geometries but also in different diesel particulate filters having the same size and geometry within specified tolerances. This shows that, even for diesel particulate filters coming from the same production line and built to the same specification, calibration is required in order to be able to infer soot load from RF data.

It can be seen from FIG. 2 that for higher levels of soot load, the relationship between mean attenuation and soot load is substantially linear. Moreover, the gradient of that relationship has little variation as between different diesel particulate filters and geometries.

It has also been determined empirically that for higher levels of the relationship between mean attenuation and soot load is substantially linear across a range of temperatures. The temperature affects the gradient of that relationship. It may be that the linear relationship is reliable only once a minimum threshold temperature is exceeded. The minimum temperature threshold may be between 125° C. and 175° C., or between 140° C. and 160° C., and 150° C. or approximately 150° C.

The model of the present invention exploits the linear region of this relationship.

The next stage is to seek to eliminate the non-linear (less predictable) parts of the relationship between mean attenuation and soot load.

Figure 3:
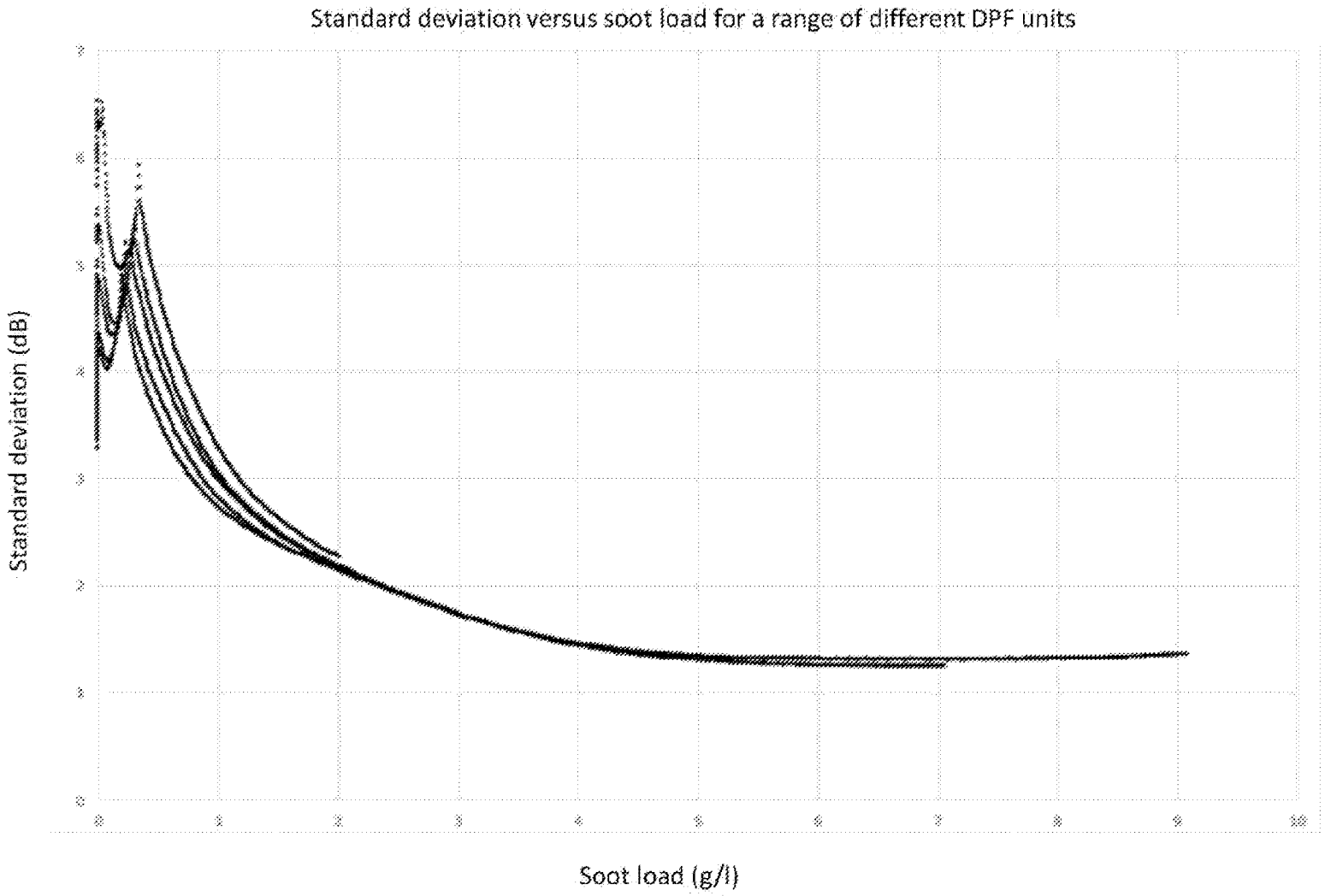
FIG. 3 shows, for the range of diesel particulate filters at the fixed temperature, a plot of attenuation standard deviation versus known soot load.

FIG. 3 shows a shows a plot of the standard deviation attenuation against soot load for a range of different products at a constant temperature. From this it can be seen that, for an inferred soot load of approximately 0.5 g/l, there is a first resonant peak where standard deviation is high. There is then a second peak in standard deviation at approximately 1.4 g/l. Subsequent to the second peak, the standard deviation drops gradually without further peaks. The peaks are attributed to resonance phenomena in the radio frequency behaviour.

These two peaks in standard deviation correspond with the non-linear parts of the FIG. 2 plot. By contrast, the parts of the curves shown in FIG. 3 that follow the two peaks in standard deviation correspond with the substantially linear parts of FIG. 2.

Figure 4:
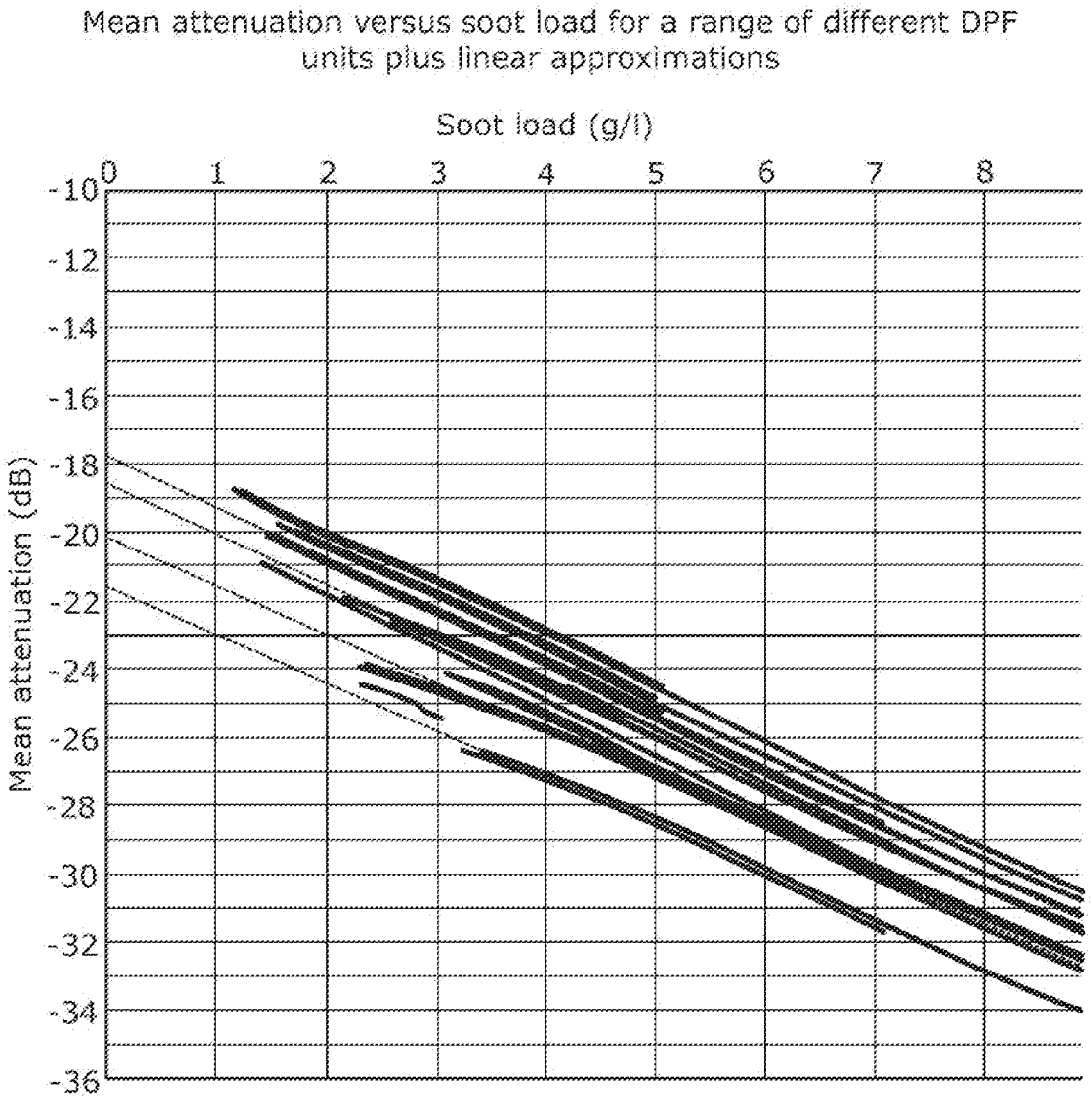
FIG. 4 shows the plot of FIG. 2 with non-linear portions removed.

Accordingly, development of the model of the present disclosure has involved eliminating from the FIG. 2 data a subset of data associated with the higher standard deviations shown in FIG. 3, so as to retain the data having a linear relationship. FIG. 4 shows a plot similar to that of FIG. 2 except that the data relating to the region shown in FIG. 3 to have high standard deviation has been eliminated.

A standard deviation threshold below which data are eliminated may be between 2.1 dB and 2.7 dB, or between 2.3 dB and 2.5 dB, or 2.4 dB or approximately 2.4 dB.

Having eliminated the mean RF attenuation data associated with a high standard deviation (e.g. the peaks of FIG. 3) it can be seen from FIG. 4 that, for each diesel particulate filter, the relationship between mean attenuation and soot loading, at the specified temperature, is approximately linear. Some of the linear approximations are shown in dotted lines. (For clarity, not all the linear approximations are shown.)

Figure 5:
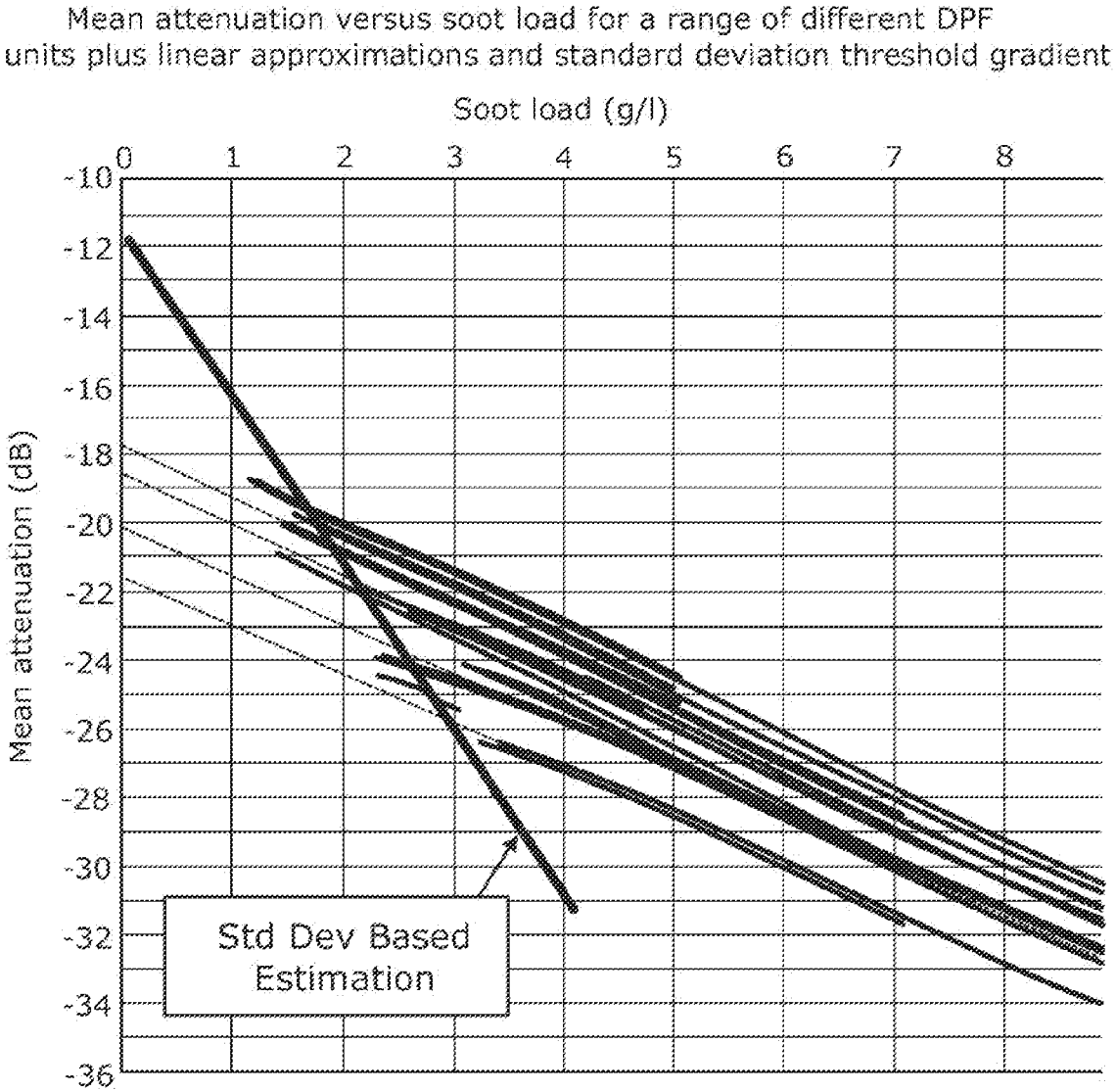
FIG. 5 shows the plot of FIG. 4 with a line representing a standard deviation of 2.4 dB also shown from which it can be seen that data with a standard deviation of more than 2.4 dB all falls within the linear portions of the lines for each diesel particulate filter.

FIG. 5 shows the plot of FIG. 4 plus an additional line that represents a standard deviation of 2.4 dB. It can be seen that values to the right of this standard deviation provide consistently approximately linear relationships between mean RF attenuation and soot load.

The variation between different diesel particulate filters (even those that only differ within manufacturing tolerances) is what gives rise to the offset between the various parallel lines in the FIG. 5 plot.

Having established the relationships set out here, these relationships can then be used as part of the model by which soot load is inferred from mean attenuation for a wider variety of different diesel particulate filters.

The relationships may be stored as part of a data library.

Figure 6:
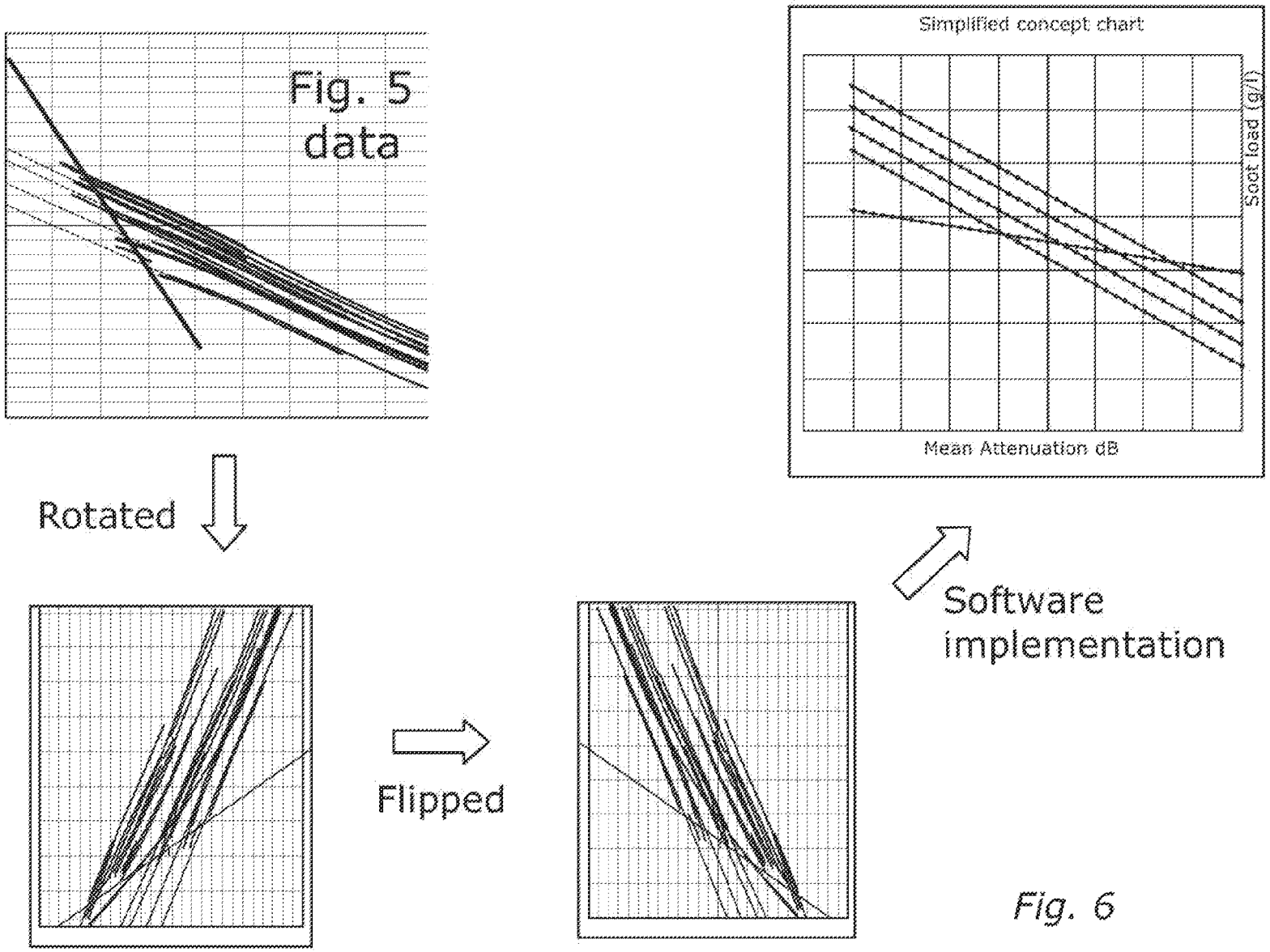
FIG. 6 shows how the empirical data for soot load against mean attenuation at a particular temperature can be processed to provide part of an approach in accordance with the present disclosure for inferring soot load from mean attenuation at that temperature.

FIG. 6 shows how the plot of FIG. 5 may be straightforwardly manipulated firstly such that the input of mean attenuation features on the x-axis while the inferred output of soot loading appears on the y-axis, and secondly such as to give rise to the possibility of establishing an equation defining each straight line. From this straight line, an offset attributable to behaviour variation of a specific diesel particulate filter may be determined.

Figure 7:
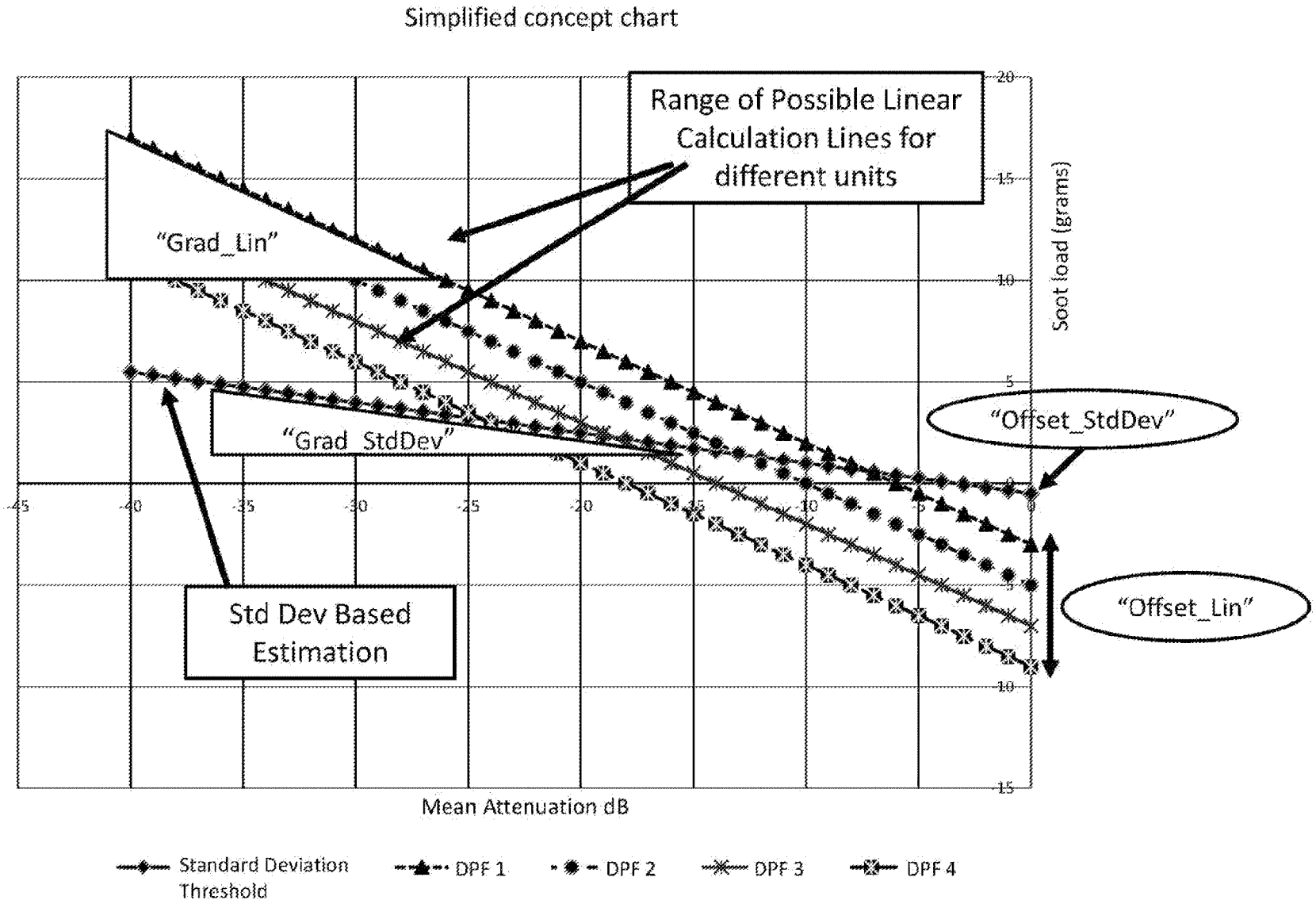
FIG. 7 shows a further step in the approach by which an axis offset may be established for a specific diesel particulate filter.

FIG. 7 shows the various constants that can be derived from the straight lines in accordance with the standard equation for a straight line, y=mx+c.

The four parallel straight lines in the FIG. 7 plot represent behaviour for four possible diesel particulate filters (DPF 1, DPF 2, DPF 3, and DPF 4), all at the same temperature. Other possibilities for parallel straight lines, having the same gradient, are possible, for different diesel particulate filters, again all at the same temperature. These possibilities may be stored in the data library.

The only straight line in the FIG. 7 plot that has a different gradient from the others represents the standard deviation based estimation by which the data associated with a high standard deviation may be eliminated. The difference between each one of the range of possible linear calculation lines may be defined by the offset at which the lines crosses the y-axis. A negative value for soot (in g/l) is clearly not possible.

The value for the linear offset in the case of a particular line may be determined using the following equation:

$$\text{Offset_lin}=\text{Grad_StdDev}*(X\text{dB})+\text{Offset_StdDev}-\text{Grad_Lin}*(X\text{dB})$$

where X dB is the mean attenuation value derived from the soot sensor in the particular diesel particulate filter in question.

Having used this formula to establish what the value is for Offset_Lin, for a particular diesel particulate filter at a particular temperature, the particular linear calculation line for that diesel particulate filter at that temperature is known.

It has been determined empirically that the offset is constant with temperature, while the gradient of the line changes with temperature.

In one example diesel particulate filter, the Offset_Lin value is determined by this method to be −5 dB. Having established this, a further range gradients—each indicative of a different temperature—may be determined wherein all of them intercept the y-axis at an attenuation value of −5 dB. These relationships are shown in FIG. 8, which illustrates the gradient for four different temperatures, Temp 1, Temp 2, Temp 3 and Temp 4.

Figure 8:
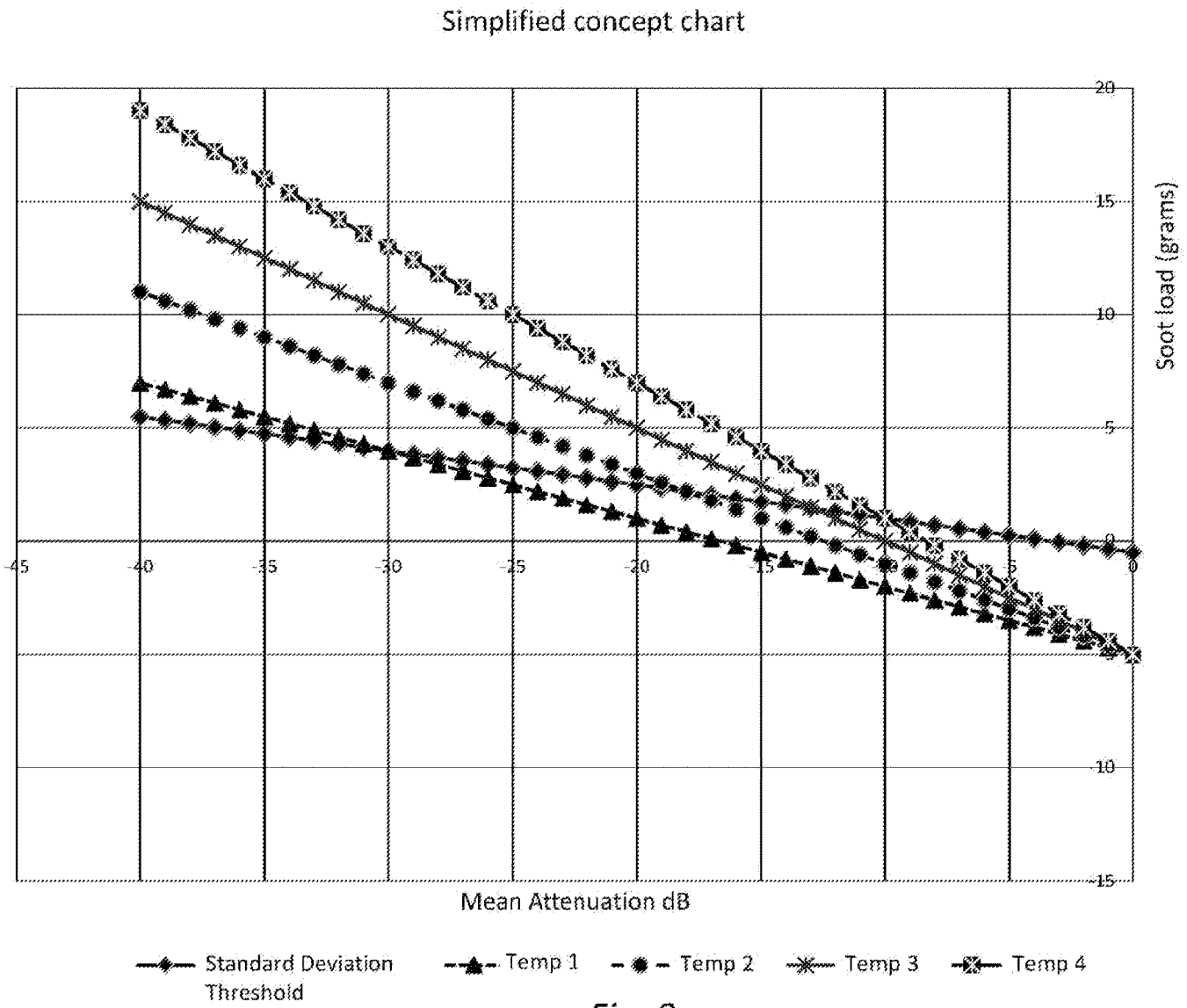
FIG. 8 shows how, having established the axis offset, that offset may be adopted to enable inference for soot load for the diesel particulate filter to be established for a variety of temperatures, wherein temperature influences gradient.
Figure 9:
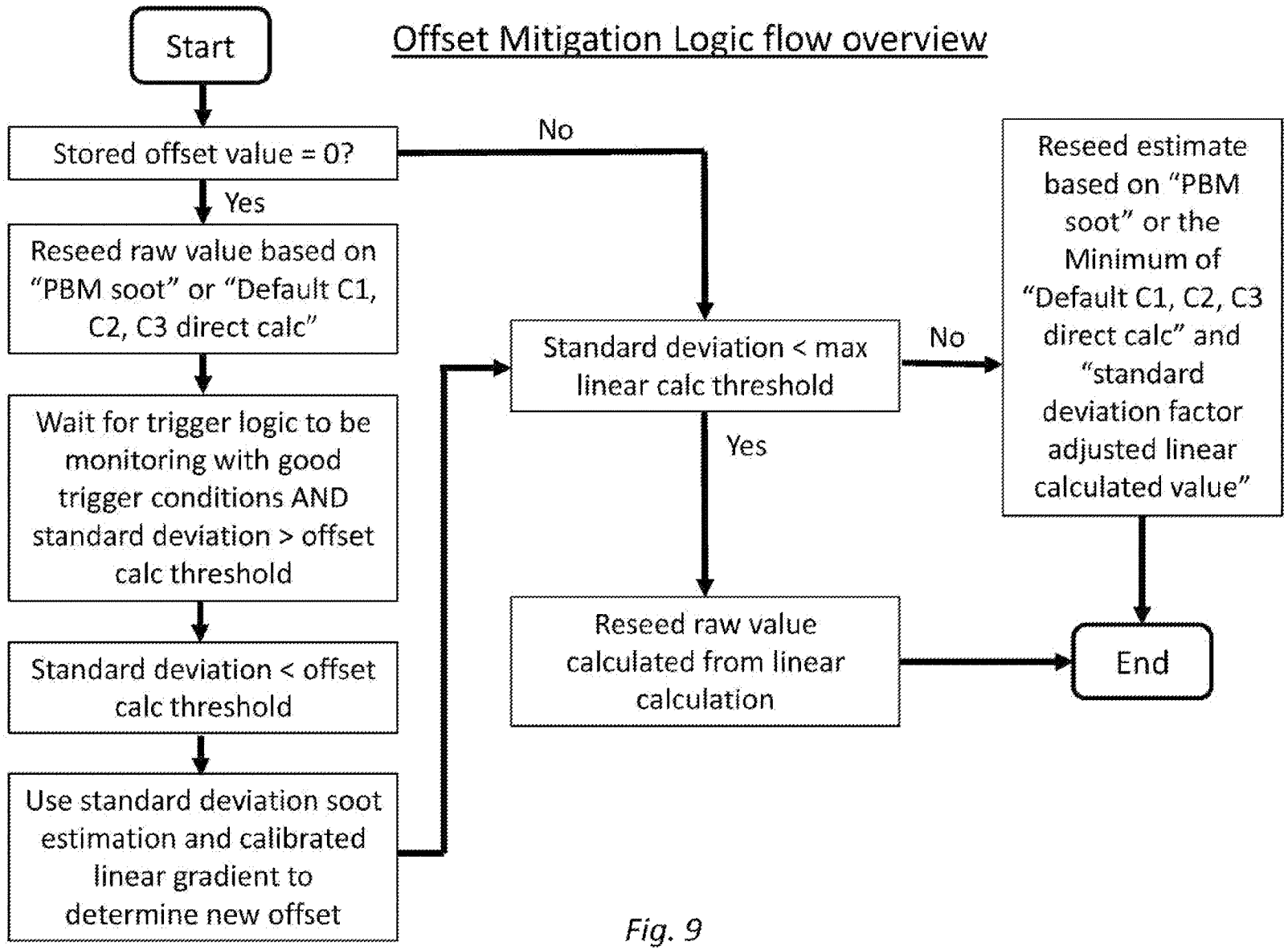
FIG. 9 shows a schematic representation of control logic for a technique for resetting the base value for a soot load inference model.

Having established these relationships, it is now possible to use temperature to determine the appropriate gradient line of the FIG. 8 example and then, for each attenuation value that exceeds the standard deviation threshold line, to infer the soot load with greater confidence. The possible gradient lines may be stored in the data library.

It may be that the linear relationship is less reliable at low temperatures. It may therefore be the case that data obtained at low temperatures is disregarded. For example, data obtained for temperatures below 125° C., or 140° C., or 150° C. or 160° C. or 175° C. may be disregarded.

While the approach set out herein gives rise to the possibility of inferring absolute soot loading at any time once the standard deviation has fallen below the standard deviation threshold, since the behaviour is largely linear it may be that once an absolute soot loading value has been inferred, a derivative model may be used to infer changes to soot loading.

One issue with a derivative model, however, is that, where inferences are incorrect, the effect of errors can propagate quickly and have a lasting effect.

Accordingly, it may be that measures are put in place to determine soot level inferences whose accuracy is deemed to be questionable such that a recalibration can be implemented using the previously described model.

Furthermore, such calibration may be employed at the start of life of a diesel particulate filter albeit that when soot is absent or low (when the standard deviation will be high).

INDUSTRIAL APPLICABILITY

In this way, it may be possible to calculate an inferred value for soot load with increased accuracy. Moreover, it may be possible to trigger a recalibration of the model in an event that a current soot load estimate falls outside an expected envelope. For example, a modest creep may arise over time which may be corrected by repeating the recalibration.

The model may also be employed across a wide range of different diesel particulate filters using a generic radio frequency sensor. Thus, not only variation between nominally identical diesel particulate filters coming from the same production line but also variation between diesel particulate filters of different designs and geometries can be accounted for by use of the one soot load inferring model disclosed herein.

Accordingly, increase accuracy in estimating soot load may be achieved across a wide range of diesel particulate filters.

What is claimed is:

1. A method of calibrating a soot load estimating function for a diesel particulate filter, the method comprising:

transmitting a plurality of radio frequencies into a first end of the diesel particulate filter;

sensing the plurality of radio frequencies received at a second end of the diesel particulate filter;

receiving a first temperature value for the diesel particulate filter;

obtaining mean radio frequency attenuation data and standard deviation attenuation data in relation to the transmitted and sensed radio frequencies;

identifying a mean attenuation value associated with a standard deviation that exceeds a standard deviation threshold and using this mean attenuation value as a reference value;

using a data library that contains gradient values for each of a range of possible temperature values to obtain a first gradient value, the first gradient value corresponding to the first temperature value, wherein each gradient value relates to the gradient of a linear approximation between mean attenuation and soot load at the corresponding temperature;

using the reference value and the first gradient value to determine an axis intercept value for use as an offset value;

adopting the offset value as a temperature-independent calibration value for the diesel particulate filter.

2. The method of claim 1 wherein the step of determining an intercept value involves the following calculation:

$$\text{Offset_lin}=\text{Grad_StdDev}*(X\text{dB})+\text{Offset_StdDev}-\text{Grad_Lin}*(X\text{dB})$$

wherein:

Offset_lin is the intercept value to be calculated;

Grad_StdDev is a threshold gradient value of a line representing the standard deviation threshold for soot load versus mean attenuation;

X dB is the mean radio frequency attenuation data in relation to the transmitted and sensed radio frequencies;

Offset_StdDev is a standard deviation intercept value of the line representing the standard deviation threshold for soot load versus mean attenuation; and Grad_Lin is the first gradient value.

3. The method of claim 1 wherein a condition of carrying out the method is that the first temperature value for the diesel particulate filter exceeds a minimum temperature threshold.

4. The method of claim 3 wherein the minimum temperature threshold is between 125° C. and 175° C., more preferably between 140° C. and 160° C.

5. The method of claim 4 wherein the minimum temperature threshold is 150° C. or approximately 150° C.

6. The method of claim 1 wherein the standard deviation threshold is between 2.1 dB and 2.7 dB, more preferably between 2.3 dB and 2.5 dB.

7. The method of claim 6 wherein the standard deviation threshold is 2.4 dB or approximately 2.4 dB.

8. The method of claim 1 wherein the plurality of radio frequencies comprises between 100 and 300 discrete frequencies.

9. The method of claim 8 wherein the plurality of radio frequencies comprises 200 discrete frequencies or approximately 200 discrete frequencies.

10. A method of estimating current soot load of a diesel particulate filter calibrated in accordance with claim 1, the method comprising:

receiving a second temperature value for the diesel particulate filter;

receiving a second mean attenuation value associated with a standard deviation that is below the standard deviation threshold;

using the data library to obtain a second gradient value corresponding to the second temperature value;

using the second gradient value, the second mean attenuation value and the calibration value to determine a corresponding current soot estimate.

11. The method of claim 10 further comprising repeating the calibration method of claim 1 to obtain a replacement value for the temperature-independent calibration value in an event that a current soot load estimate falls outside an expected soot load envelope.

12. A method of estimating current soot load of a diesel particulate filter, the method comprising estimating a change in soot load relative to a previous soot load value and thereby estimating a current soot load, wherein an initial soot load is determined in accordance with the method of claim 1.

13. The method of claim 12 comprising check functionality that is configured to trigger in an event that an estimated soot load falls outside an expected envelope, wherein in an event that the check functionality is triggered, the method of claim 1 is repeated to provide a new previous soot load value.

14. An engine assembly comprising an internal combustion engine, an aftertreatment apparatus, an engine control module and a radio frequency soot sensor for providing radio frequency data in relation to the aftertreatment apparatus, wherein the engine control module and the radio frequency soot sensor are configured to perform the method of claim 1.

* * * * *